US007215306B2

(12) United States Patent
Lo

(10) Patent No.: US 7,215,306 B2
(45) Date of Patent: May 8, 2007

(54) DRIVING APPARATUS FOR AN ACTIVE MATRIX ORGANIC LIGHT EMITTING DISPLAY

(75) Inventor: Shin-Tai Lo, Miaoli (TW)

(73) Assignee: Wintek Corporation, Taichung (TW)

( * ) Notice: Subject to any disclaimer, the term of this patent is extended or adjusted under 35 U.S.C. 154(b) by 504 days.

(21) Appl. No.: 10/740,475

(22) Filed: Dec. 22, 2003

(65) Prior Publication Data

US 2005/0134536 A1 Jun. 23, 2005

(51) Int. Cl.
*G09G 3/30* (2006.01)
*G09G 3/32* (2006.01)
*G09G 5/10* (2006.01)

(52) U.S. Cl. ..... 345/76; 345/82; 345/690; 345/214; 315/169.1; 315/169.2; 315/169.3

(58) Field of Classification Search ..... 345/76–80, 345/82, 690, 691, 211, 214; 315/169.1–169
See application file for complete search history.

(56) References Cited

U.S. PATENT DOCUMENTS 6,380,689 B1 * 4/2002 Okuda ..... 315/169.3
6,452,241 B1 9/2002 Yamauchi et al.
6,452,341 B1 * 9/2002 Yamauchi et al. ..... 315/169.1
6,872,973 B1 * 3/2005 Koyama et al. ..... 257/59
6,879,110 B2 * 4/2005 Koyama ..... 315/169.1

FOREIGN PATENT DOCUMENTS

JP 2001-343933 A 12/2001

* cited by examiner

*Primary Examiner*—Henry N. Tran
(74) *Attorney, Agent, or Firm*—Bacon & Thomas, PLLC

(57) ABSTRACT

A driving apparatus of a multiple-scanning driving circuit relating to a simple pixel structure of 2T1C (2 TFTs and 1 capacitor) includes a write-scan circuit, an erase-scan circuit and a data driving circuit. A write-enable line connected to the write-scan and the data driving circuits is used to control the signals of these two circuits. One erase-enable line connected to the erase-scan and the data driving circuits is used to control the signals of these two circuits. Thus, a circuit system of time-multiplex multiple write-scan and erase-scan is completed to solve the problems of a low time utility rate and an insufficient luminance in a digital driving AMOLED system.

8 Claims, 7 Drawing Sheets

DRIVING APPARATUS FOR AN ACTIVE MATRIX ORGANIC LIGHT EMITTING DISPLAY

FIELD OF THE INVENTION

This invention relates to driving method for an active matrix organic light emitting display. More particularly, the invention is directed to improve the problem of a low time utility rate in a digital driving system for an active matrix organic light emitting display (AMOLED).

BACKGROUND OF THE INVENTION

Organic Light Emitting Displays (OLED) can be divided into passive matrix and active matrix according to driving methods. The so-called active matrix OLED (AMOLED) is to use a thin film transistor (TFT) and the capacitor to store signals and control the luminance and the gray scale of OLED.

For driving technology at present, development of AMOLED has two directions; one is the analog method and the other is the digital way. The reason why digital driving was developed is because TFT elements with uniform features (e.g. threshold voltage and mobility) can't be produced through the current LTPS process. Nevertheless, the stringent demands for LTPS process are not required for digital driving since characteristic variation of TFT elements can be compensated merely through a simple 2T1C driving circuit.

As a result, digital driving technology will play a certain role for the development of AMOLED in the future if shortcomings of digital driving method can be corrected efficiently and the integrated driving system can be established.

The driving structure of the digital driving technology in practice is based on Program Display Separation as shown in FIG. 1. One defect of this method is the low time utility rate since OLED is not allowed to be illuminated during sub-frame writing time from sub-frame SF1 through SF6 and the total writing time from sub-frame SF1 through SF6 occupies a certain portion of frame time. 1~N refers to the scan line and 1~M refers to the display line. For each sub-frame (SF1~SF6), the writing time is the same and the luminance time is T, 2T, 4T, 8T, 16T and 32T in order respectively. Take FIG. 1 as an example. When the resolution of the display panel is 176×240 with the scanning frequency of 120 KHz, the writing time length of a sub-frame equals to (1/120K)×240=2 ms. Consequently, the total writing time for 6 sub-frames SF1~SF6 will be 12 ms, which occupies 60% of a frame time (1 frame=1/50 sec=20 ms). As OLED is not illuminated during writing time, the time utility rate only achieves 40%, which is low and might lead to insufficient brightness of the display panel.

Take the U.S. Pat. No. 6,452,341 as an example for time-ratio technology. It is based on the structure of Program Display Separation for the realization of digital driving. Though this approach is easy to implement and the hardware system is less complicated; however, time utility rate is low since the total writing time from sub-frame SF1 through SF6 occupies a certain portion of frame time.

Japan Pat. No. 2001-343933 discloses a method for driving AMOLED. The driving elements in every pixel include a writing TFT, an erase TFT, a driving TFT, a storage capacitance, and an organic electro-luminescence element. The gate of the writing TFT is connected to the write scan line and the gate of the erase TFT is connected to the erase scan line. Gray scale is adjusted by modulating the luminance time ratio in this patent, which improves the flaw of low time utility rate in the driving structure of program display separation. Whereas, driving elements with three TFT (3T1C) are required leading an improvement in complexity of the driving method and aperture ratio of pixels to be desired.

SUMMARY OF THE INVENTION

The main purpose of this invention is to solve the aforementioned problems existed for a long time. The problems of low time utility rate and insufficient luminance in a digital driving system of AMOLED can be solved by this invention.

To achieve the objective above, this invention introduces a multiple-scanning circuit into the display driving system and maintains a 2T1C simple pixel structure of the display panel. This circuit system consists of an active matrix TFT-OLED panel, a write-scan circuit connected to the scan line, an erase-scan circuit connected to the scan line corresponding to the write-scan circuit, a data driving circuit connected to the data line;

a write-enable line connected to the above write-scan and data driving circuits to control the signals of both circuits;

and an erase-enable line connected to the above erase-scan and data driving circuits to control the signals of both circuits.

Consequently, two sets of scanning circuits and one set of data circuit not only reduce the complexity to the greatest extent, but also increase time utility rate of a digital system efficiently. A pixel with a high aperture ratio is achieved since every pixel maintains a simple 2T1C structure.

DETAILED DESCRIPTION OF THE PREFERRED EMBODIMENT

Figure 1:
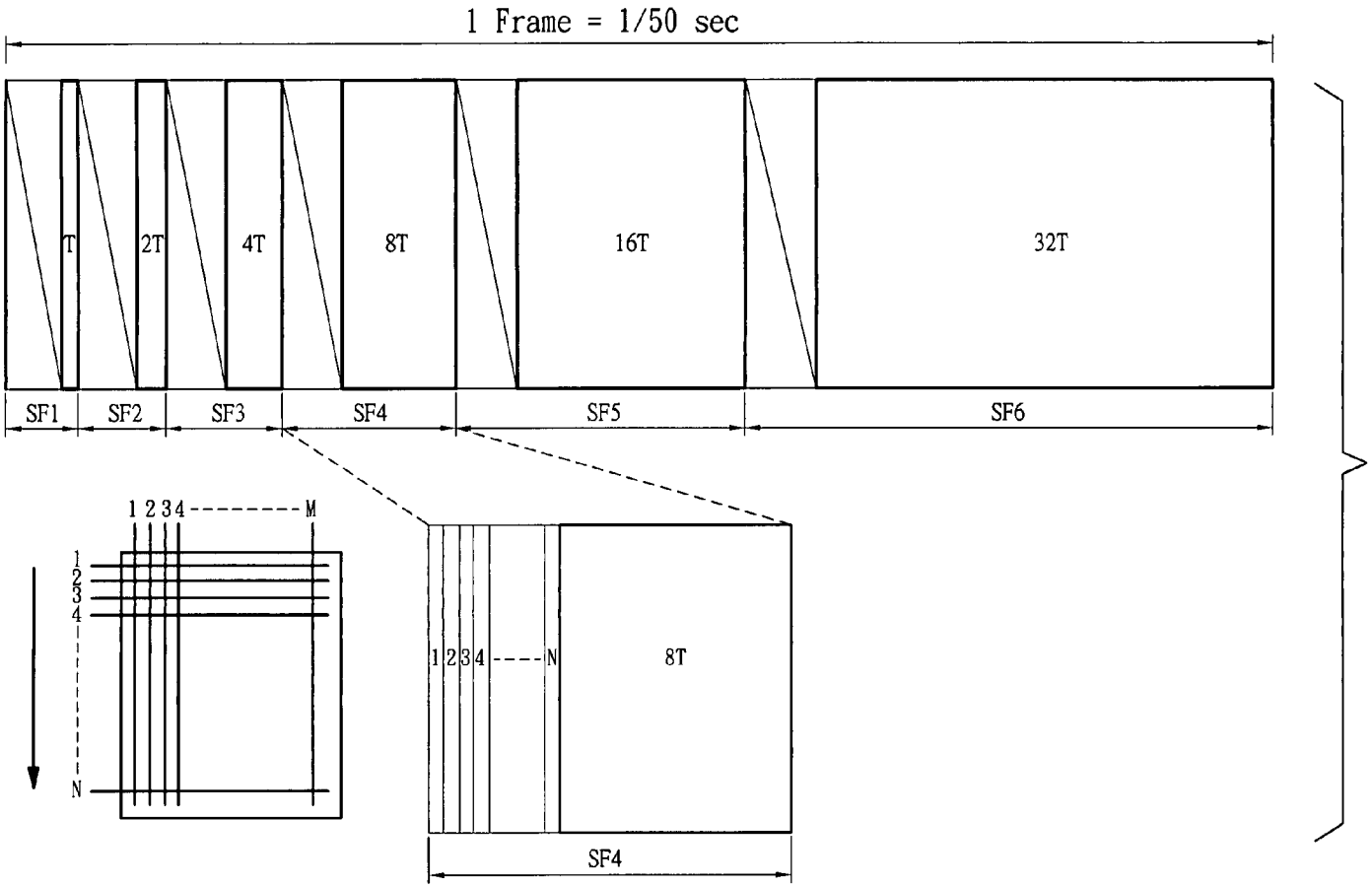
Fig. 1 PRIOR ART
FIG. 1 shows a diagram of driving structure for program display separation in practice.
Figure 2:
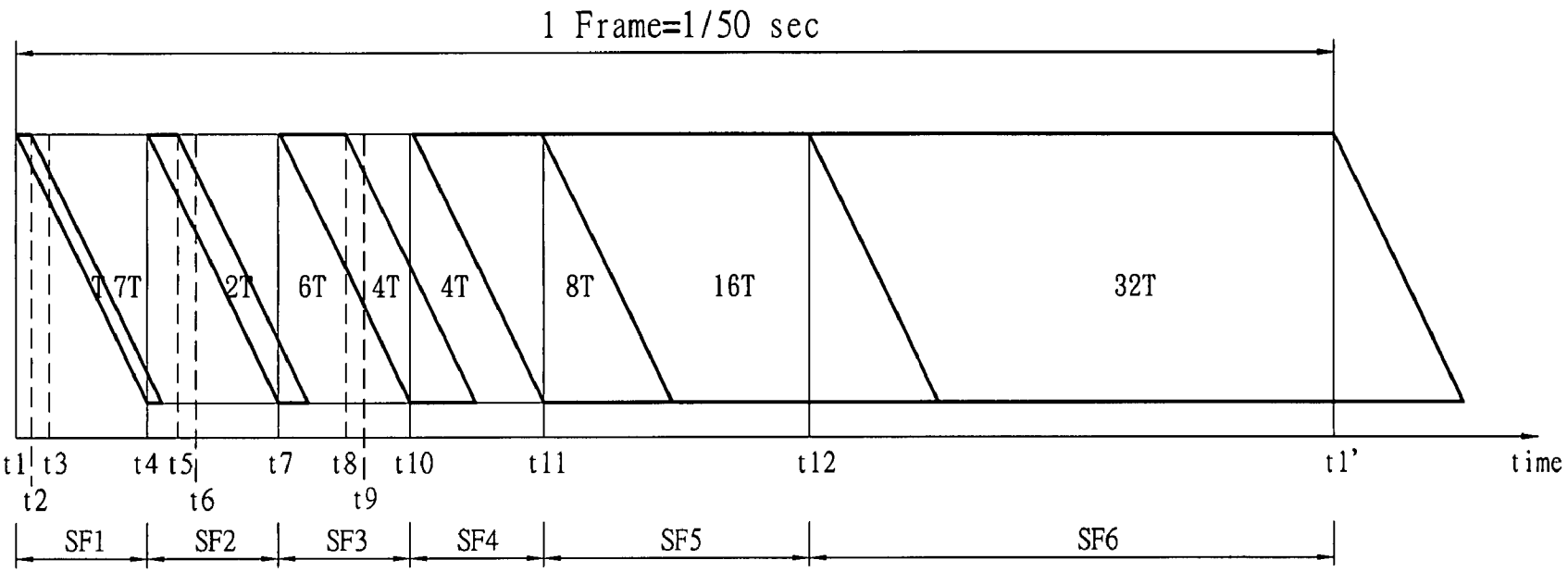
FIG. 2 shows a diagram of a high time utility rate driving structure.

A description of the content and the technology of this invention along with drawings is made in detail as follows:

Refer to FIG. 2 for a high time utility rate driving structure. The feature of this driving method is that pixels on the scan line enter the data display phase immediately after the scan line finishes data writing. And we can find that two actions need to be realized at time point t3. One is to execute the writing of a certain scan line and the other is to execute the erasing of another scan line. If a multiple scan driving circuit and a data driving circuit is designed, the driving method of FIG. 2 would be put into practice successfully.

Due to the limitation of scan frequency, some scan lines have finished the data display phase in a certain sub-frame, however, some scan lines are still waiting for data writing of the sub-frame. Thus, the scan lines that have completed the data display have to start to execute the data erasing. Take FIG. 2 as an example. Frame time of this driving method is (8T+8T+8T+8T+16T+32T)=80T and luminance time of six sub-frames (SF1~SF6) occupies 78.75% of the frame time ((T+2T+4T+8T+16T+32T)/80T=78.75%). The time utility rate can be increased to 78.75% by the driving method shown in FIG. 2.

A driving apparatus is presented by this invention to realize the aforementioned high time utility rate driving method.

Figure 3:
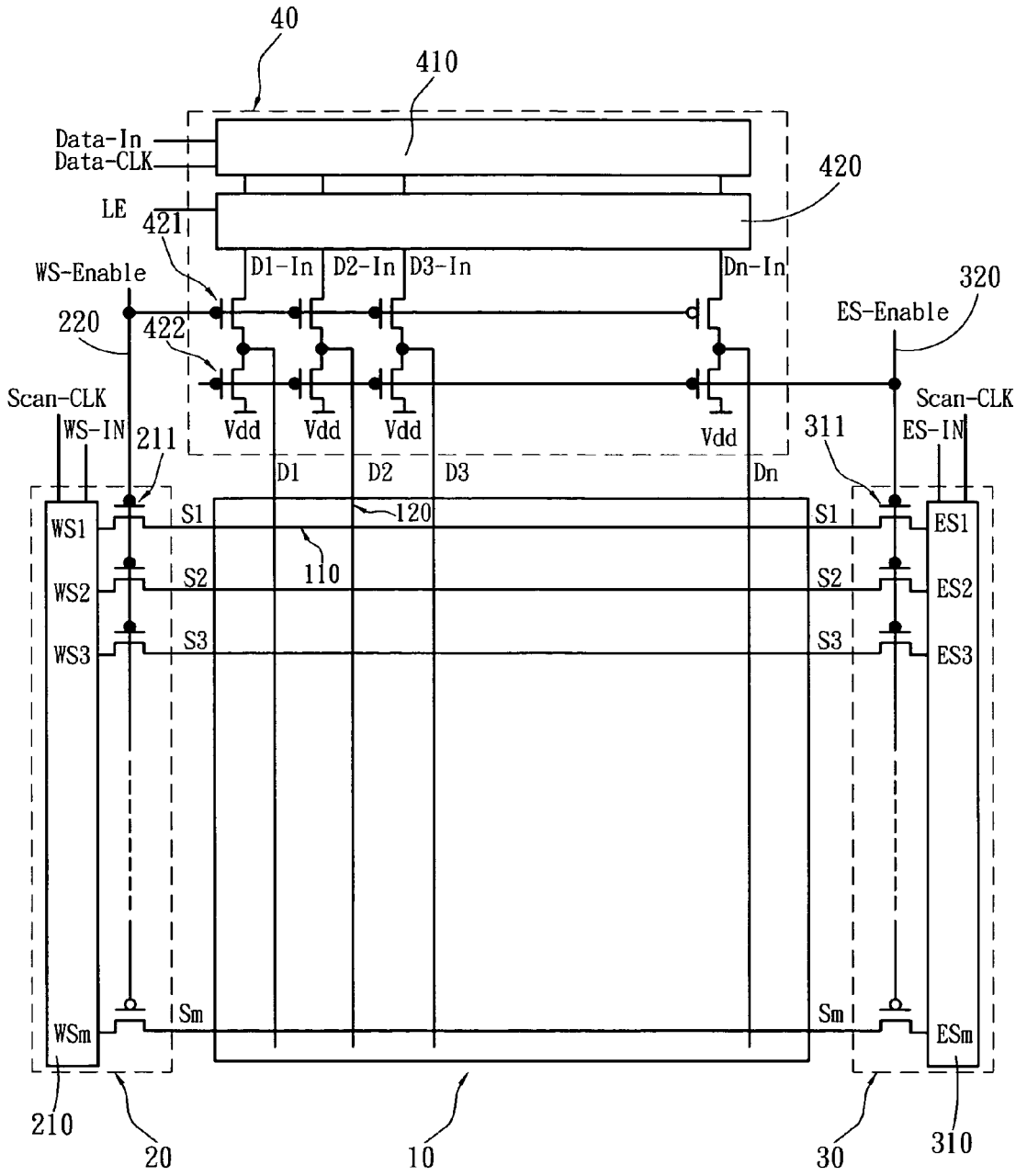
FIG. 3 shows the circuit system of this invention.

Refer to FIG. 3 for the circuit system of this invention. As shown in FIG. 3, WS-IN is the initial input signal of a write-scan circuit 20, ES-IN is the initial input signal of an erase-scan circuit 30; Scan-CLK is the clock signal of the write-scan circuit 20 and erase-scan circuit 30, and LE is the latch signal of the data latch of a data driving circuit 40. As shown in the diagram, this invention relates to the multiple-scanning driving method based on a 2T1C (2 TFTs, 1 capacitor) simple pixel structure to realize the high time utility rate driving method shown in FIG. 2. The multiple-scanning circuit system comprises:

An active matrix TFT-OLED panel 10 composed of horizontal scan lines 110 and vertical data lines 120;

a write-scan circuit 20 connected to the aforementioned scan line 110; wherein one write-scan shifter 210 and several write switches 211 are installed in the write-scan circuit 20. Every write switch 211 is connected between the corresponding scan line 110 and write-scan shifter 210 on active matrix TFT-OLED panel 10 as a multiplex switch. In addition, the write switch 211 is connected to a write-enable line 220 in control of ON or OFF signal of the switch.

An erase-scan circuit 30 connected to the scan line 110 and corresponding to the write-scan circuit 20; wherein, an erase-scan shifter 310 and several erase switches 311 installed in the erase-scan circuit 30. Every erase switch 311 is connected between the corresponding scan line 110 and erase-scan shifter 310 on the active matrix TFT-OLED panel 10 as a multiplex switch. Furthermore, the erase switch 311 is connected to an erase-enable line 320 in control of ON or OFF signal of the switch.

A data driving circuit 40 connected to the data line 120; wherein, a data shifter 410, a data latch 420 connected to data shifter 410 and several first switches 421 installed. Every first switch 421 is connected between the corresponding data line 120 and the data latch 420 on the active matrix TFT-OLED panel 10. Furthermore, the first switch 421 is connected to the write-enable line 220 in control of ON or OFF signal of the switch.

Each second switch 422 is connected to the corresponding first switch 421 and the erase-enable line 320 in control of ON or OFF signal of the switch. The other end of second switch 422 is connected to high potential (Vdd).

The write-enable line 220 connected to the write switch 211 of the write-scan circuit 20 and first switch 421 of data driving circuit 40 in control of signals of both circuits;

the erase-enable line 320 connected to erase switch 311 of the erase-scan circuit 30 and second switch 422 of the data driving circuit 40 in control of signals of both circuits;

In summary, there are two shifters for the scan driving circuit of this invention. One is write-scan shifter 210 and the other is erase-scan shifter 310. To realize the time-multiplex multiple-scanning (write-scan and erase-scan) operation, a switch (write switch 211 and erase switch 311) has to be series connected to each output of both shift circuits and controlled by WS-Enable signals from the write-enable line 220 and ES-Enable signals from the erase-enable line 320. Outputs of these two corresponding switches will be connected to the same scan line 110. Outputs of the write-scan shifter 210 and erase-scan shifter 310 will appear on scan line 110 at different time periods by the control of WS-Enable and ES-Enable signals.

First switch 421 of the data driving circuit 40 and second switch 422 are controlled by WS-Enable signals of the write-enable line 220 and ES-Enable signals of the erase-enable line 320. Outputs of data voltage and high potential (Vdd) will appear on the data line 120 at different time periods by the control of WS-Enable and ES-Enable signals.

Figure 4:
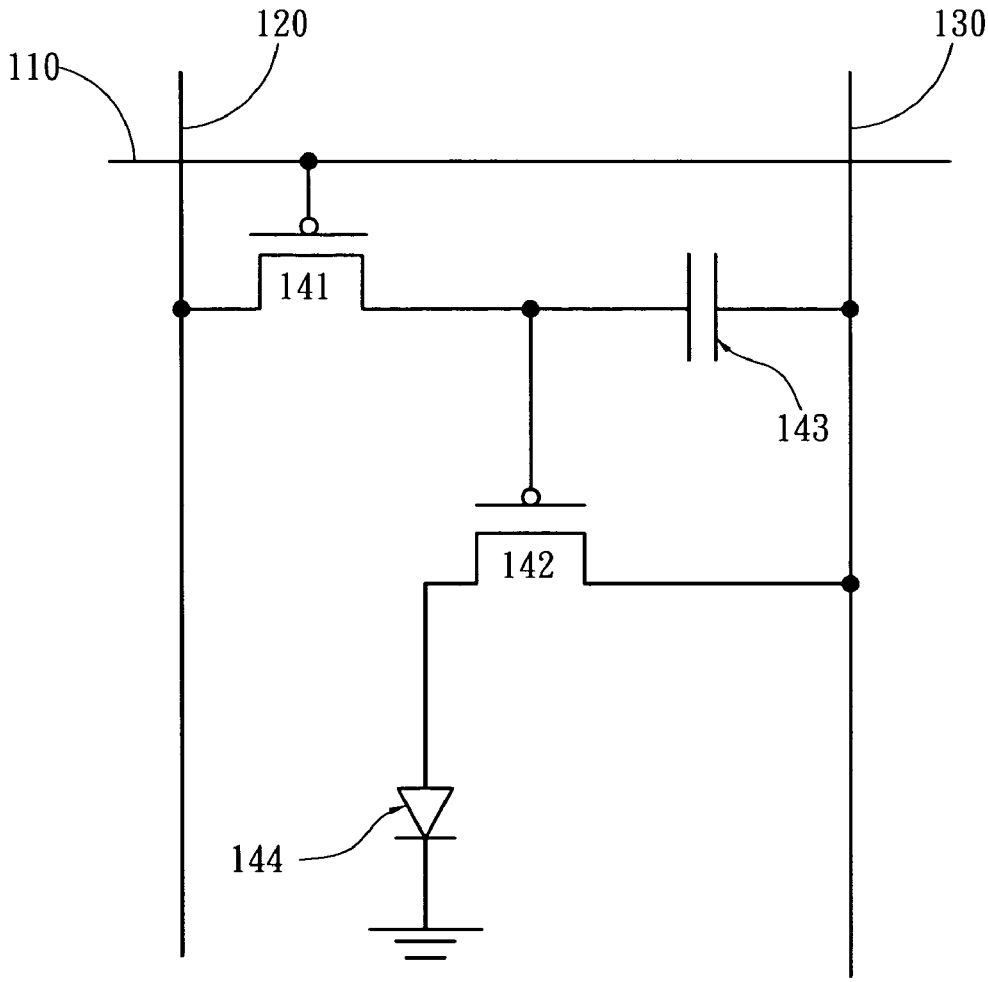
FIG. 4 shows the circuit of every pixel for this invention.

Refer to FIG. 4 for the circuit of every pixel in this invention. The pixel circuit includes a writing TFT 141 whose gate connected to the scan line 110 and source connected to the data line 120;

a storage capacitance with a end connected to the power supply line 130 and the other end connected to drain of a writing TFT 141;

a driving TFT 142 whose source connected to the power supply line 130 and gate connected to the joint where storage capacitance 143 and writing TFT 141 meet;

and an organic electro-luminescence element 144 with the positive electrode connected to the drain of driving TFT 142 and negative electrode grounded.

The aforementioned writing, erase, first and second switches are thin film transistors (TFT).

Figure 5:
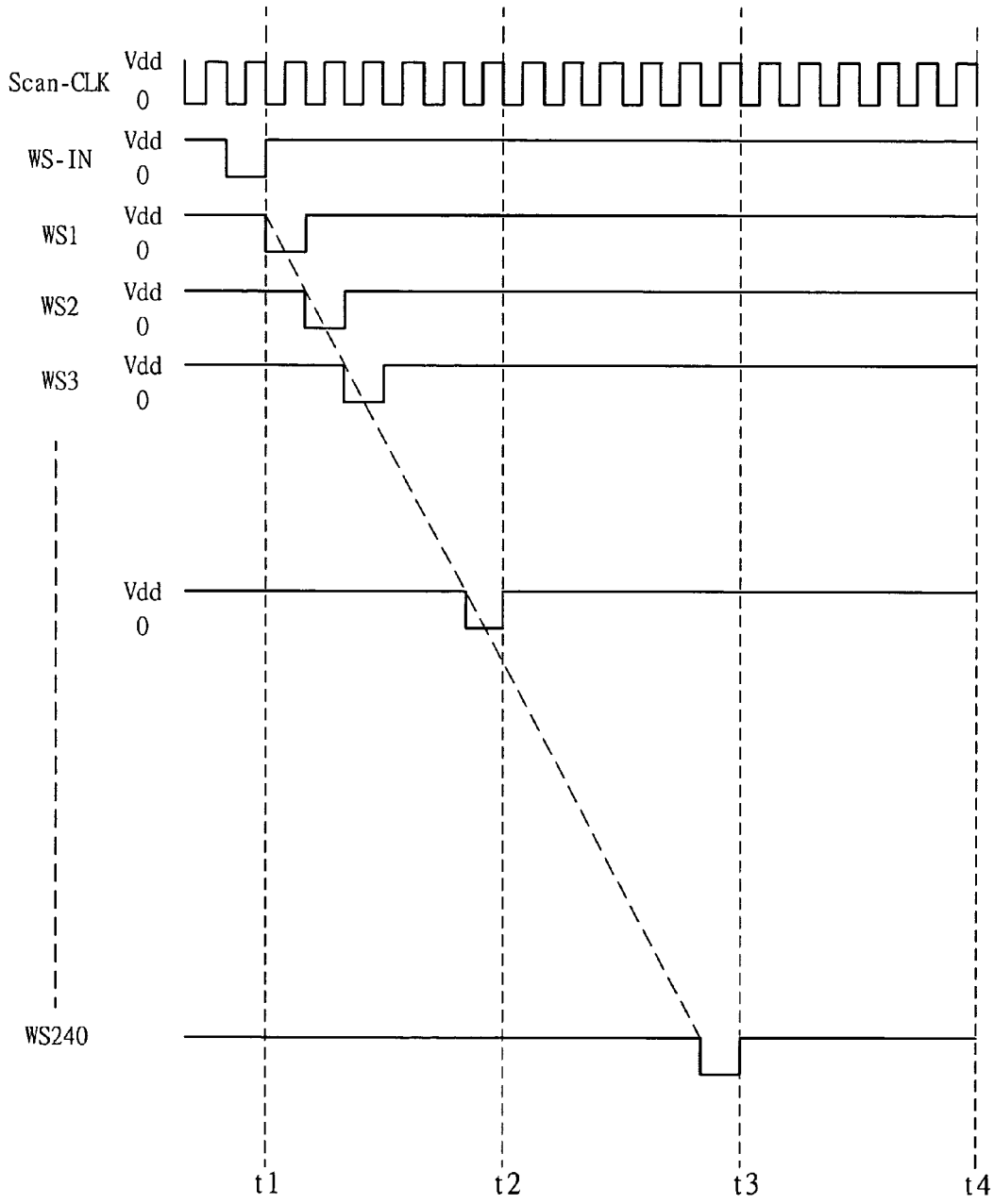
FIG. 5 illustrates write-scan shifting sequences in this invention.
Figure 6:
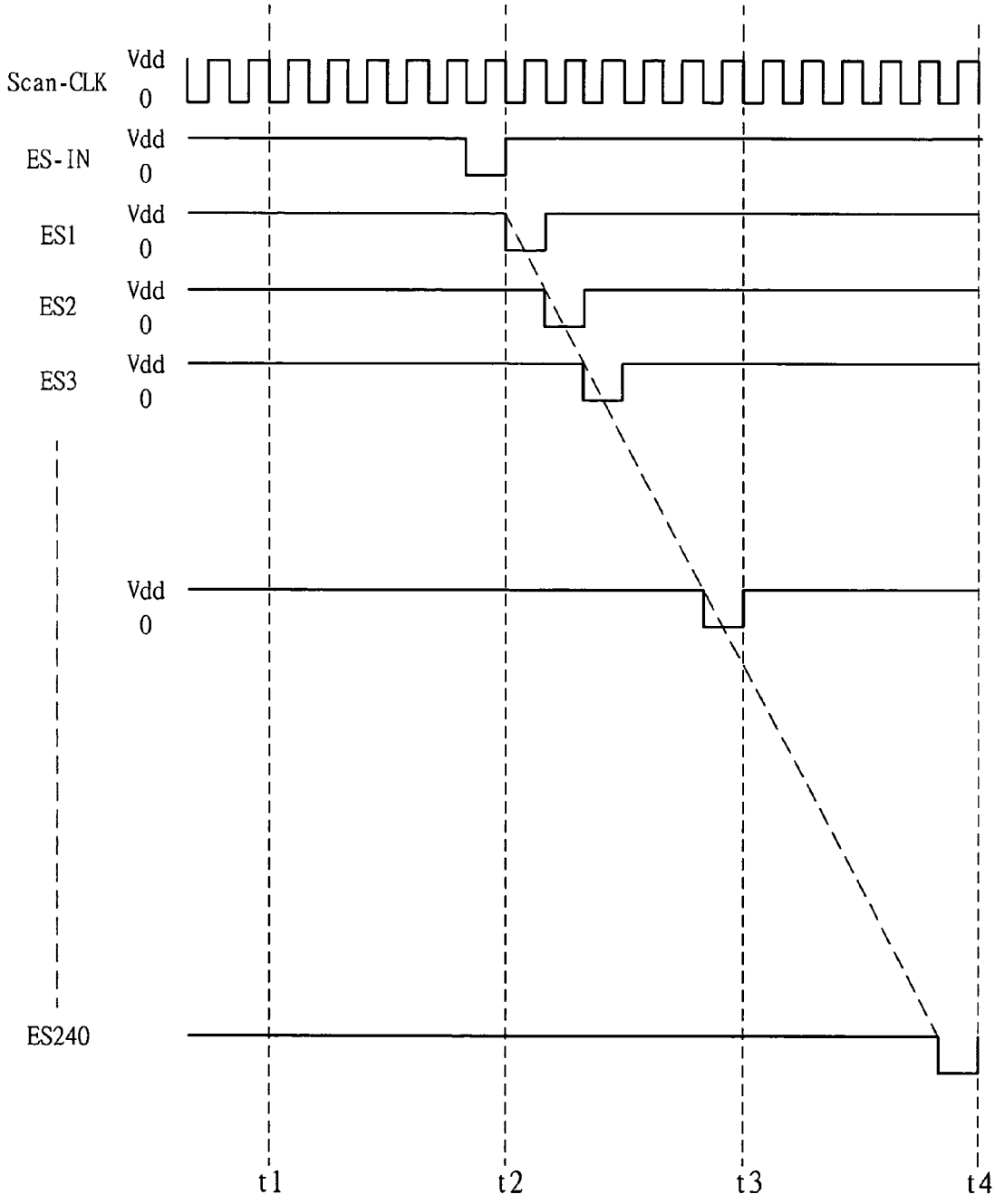
FIG. 6 illustrates erase-scan shifting sequences in this invention.
Figure 7:
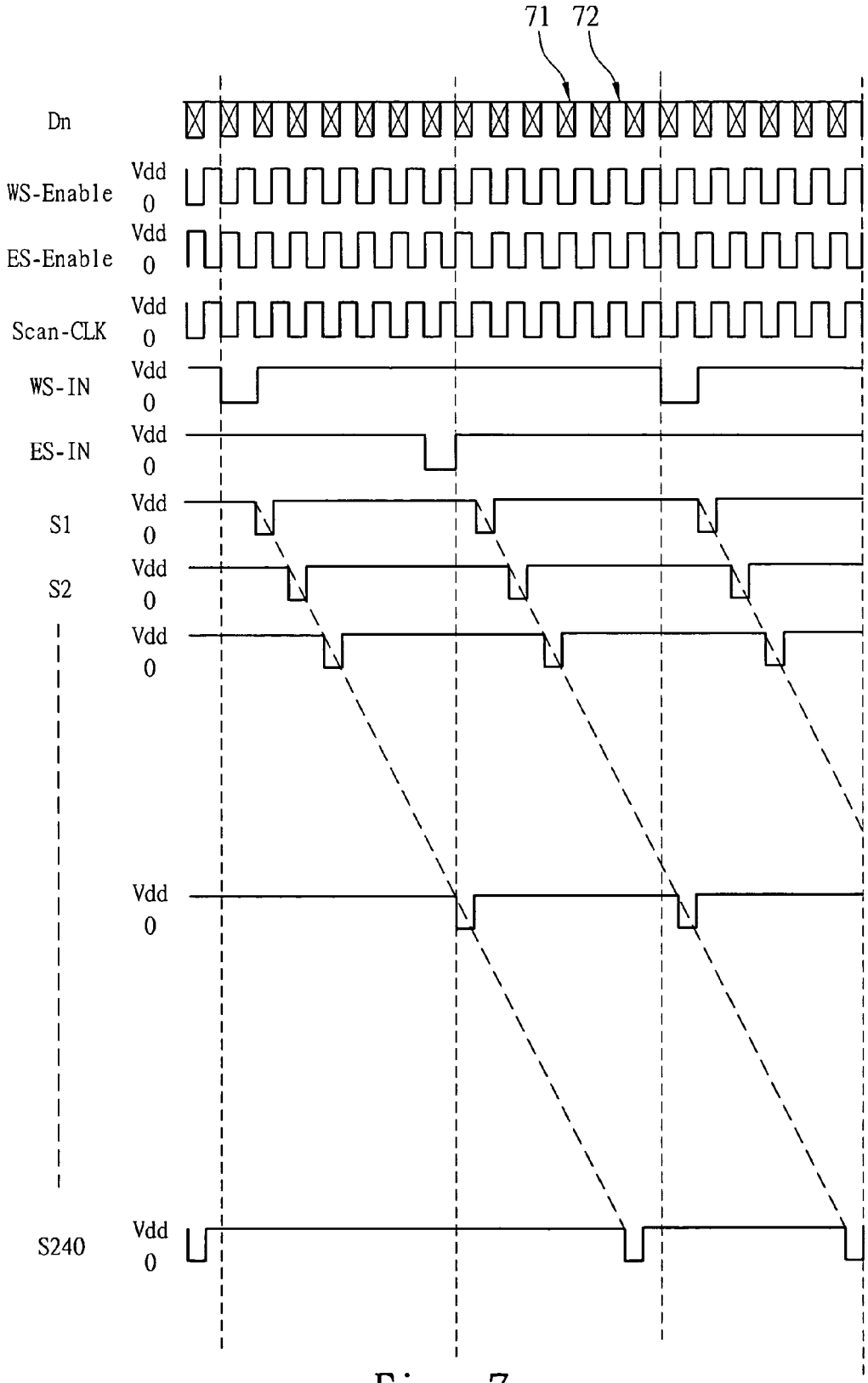
FIG. 7 illustrates shifting sequences of the circuit system in this invention.

Refer to FIG. 5, FIG. 6 and FIG. 7 for the illustration of shifting sequences for write-scan, erase-scan and circuit system of this invention. Outputs of write-scan shift and data voltage appear on the scan line 110 and data line 120 respectively through WS-Enable and ES-Enable signals. It is called write period 71 at this moment and writing of a certain scan line starts during this phase. Afterwards, outputs of erase-scan shift and high potential(Vdd) show up on the scan line 110 and data line 120 respectively, which is called erase period 72 and erasing of another scan line 110 beings at this stage.

To conclude, the method driving for a time-multiplex multiple write and erase scanning of this invention has the following advantages: (1) A digital-based structure improves uneven images on an LTPS AMOLED panel. (2) Problems of low time utility rate and insufficient luminance in a digital system can be solved. (3) A 2T1C simple construction is designed for each pixel circuit, which has a higher aperture ratio compared with related technology in practice. (4) Reduce complexity of a circuit to the greatest extent; i.e., time utility rate of a digital system can be increased efficiently by merely use of two sets of scan circuits and one set of data circuit.

What is claimed is:

1. The driving apparatus of a multiple-scanning driving circuit based on a 2T1C (2 TFTs, 1 capacitor) simple pixel structure to achieve the high time utility rate driving method comprises:

an active matrix TFT-OLED panel composed of horizontal scan lines and vertical data lines;

a write-scan circuit connected to the aforementioned scan lines for receiving write-scan input signals;

an erase-scan circuit connected to the scan lines corresponding to the write-scan circuit for receiving erase-scan input signals;

a data driving circuit connected to the data lines for receiving data-in signals;

a write-enable line connected to the write-scan circuit and the data driving circuit for providing a write-enable signal in control of the write-scan input signals of the write-scan circuit and the data-in signals of the data driving circuit;

an erase-enable line connected to the erase-scan circuit and the data driving circuit for providing an erase-enable signal in control of the erase-scan input signals of the erase-scan circuit and the data-in signals of the data driving circuit.

2. The driving apparatus of a multiple-scanning driving circuit according to claim 1, the pixel circuit includes:

a writing TFT whose gate connected to scan line and source connected to data line;

a storage capacitance with one end connected to power supply line and the other end connected to drain of writing TFT;

a driving TFT whose of which source connected to the power supply line and gate connected to the joint where storage capacitance and writing TFT meet; and an organic electro-luminescence element with the positive electrode connected to the drain of driving TFT and negative electrode grounded.

3. The driving apparatus of a multiple-scanning driving circuit according to claim 1, wherein the write-scan circuit includes:

a write-scan shifter;

a plurality of write switches and each one connected between a corresponding scan line on the display panel and write-scan shifter;

wherein the write-enable signal of the write-enable line connected to the write switches to control ON or OFF of the switches.

4. The driving apparatus of a multiple-scanning driving circuit according to claim 3, wherein the write switch is a thin film transistor (TFT).

5. The driving apparatus of a multiple-scanning driving circuit according to claim 1, wherein the erase-scan circuit comprises:

an erase-scan shifter;

a plurality of erase switches and each one connected to a corresponding scan line on the display panel and erase-scan shifter; and wherein the erase-enable signal of the erase-enable line connected to the erase switches to control ON or OFF of the switches.

6. The driving apparatus of a multiple-scanning driving circuit according to claim 5, wherein the erase switch is a thin film transistor (TFT).

7. The driving apparatus of a multiple-scanning driving circuit according to claim 1, wherein the data driving circuit includes:

a data shifter;

a data latch connected to the data shifter;

a plurality of first switches with each first switch connected to the corresponding data line on the display panel and the data latch;

wherein the write-enable signal of the write-enable line connected to the first switches are in control of ON or OFF of the first switches; and a plurality of second switches with each second switch connected to a corresponding first switch; and wherein the erase-enable signal of the erase-enable line connected to the second switches to control ON or OFF of second switch, the other end of the second switches being connected to high potential (Vdd).

8. The driving apparatus of a multiple-scanning driving circuit according to claim 7, wherein the first and second switches are thin film transistors.

* * * * *